US008795107B2

(12) United States Patent
McDonald

(10) Patent No.: US 8,795,107 B2
(45) Date of Patent: Aug. 5, 2014

(54) SYMMETRICAL WOOD COMPOSITE BAT

(75) Inventor: Matthew McDonald, Galway, NY (US)

(73) Assignee: Matthew McDonald, Galway, NY (US)

( * ) Notice: Subject to any disclaimer, the term of this patent is extended or adjusted under 35 U.S.C. 154(b) by 296 days.

(21) Appl. No.: 13/016,586

(22) Filed: Jan. 28, 2011

(65) Prior Publication Data

US 2011/0195809 A1 Aug. 11, 2011

Related U.S. Application Data

(60) Provisional application No. 61/299,187, filed on Jan. 28, 2010.

(51) Int. Cl.
*A63B 59/06* (2006.01)
*A63B 59/08* (2006.01)

(52) U.S. Cl.
CPC ..... *A63B 59/06* (2013.01); *A63B 2209/00* (2013.01); *A63B 59/08* (2013.01)
USPC ..... 473/564

(58) Field of Classification Search
USPC ..... 473/457, 519, 520, 564–568
See application file for complete search history.

(56) References Cited

U.S. PATENT DOCUMENTS

| | | | | |
|---|---|---|---|---|
| 310,248 | A * | 1/1885 | Brown | 473/564 |
| 795,815 | A * | 8/1905 | Burrows | 473/564 |
| 1,367,492 | A * | 2/1921 | Miles | 473/564 |
| 2,458,919 | A * | 1/1949 | Marsden | 473/564 |
| 4,032,143 | A | 6/1977 | Mueller et al. | |
| 4,572,508 | A | 2/1986 | You | |
| 4,848,745 | A | 7/1989 | Bohannon et al. | |
| 5,114,144 | A | 5/1992 | Baum | |
| 5,301,940 | A | 4/1994 | Seki et al. | |
| 5,395,108 | A | 3/1995 | Souders et al. | |
| 5,409,214 | A | 4/1995 | Cook | |
| 5,460,369 | A | 10/1995 | Baum | |
| 5,800,293 | A | 9/1998 | MacKay, Jr. | |
| 6,334,823 | B1 * | 1/2002 | Holman | 473/564 |
| 6,827,659 | B1 * | 12/2004 | Chen | 473/564 |
| 8,257,207 | B2 * | 9/2012 | Verrengia et al. | 473/564 |
| 2006/0030437 | A1 * | 2/2006 | Bao et al. | 473/564 |
| 2007/0219026 | A1 * | 9/2007 | Lo | 473/564 |
| 2009/0275428 | A1 * | 11/2009 | Ikeda et al. | 473/564 |

* cited by examiner

*Primary Examiner* — Mark Graham
(74) *Attorney, Agent, or Firm* — Steptoe & Johnson LLP

(57) ABSTRACT

A composite bat is disclosed comprising a core and outer members, as well as inserts of other material.

14 Claims, 19 Drawing Sheets

10

SYMMETRICAL WOOD COMPOSITE BAT

PRIORITY STATEMENT

The present patent application claims priority from U.S. Provisional Patent Application No. 61/299,187, filed on Jan. 28, 2010.

FIELD AND BACKGROUND OF THE INVENTION

The present invention relates to a composite article of manufacture, and particularly a composite baseball bat made of wood or other materials, which are suitable alternative for aluminum bats.

Many baseball leagues (other than Major League Baseball) use metal bats. Historically, this primarily has been done as a cost savings measure in that wooden bats break easily and are expensive to replace. The savings from metal are substantial.

Most metal bats are made principally of aluminum, which can be coated to look like wood, but which performs far differently than wood bats. First, they make a metallic "pinging" when the ball is struck, as opposed to the "crack of the bat" heard when a wood bat strikes a ball. Second, the feel of a wooden bat's sweet spot upon striking the ball cannot be replicated with a metal bat. For that reason, metal bats are considered aesthetically unpleasing by some traditionalists used to the appearance, performance and sound of wood bats.

In addition to the shortcomings noted above, metal bats are coming under increased scrutiny due to the speed of the ball off of the bat. Pitchers and other players and spectators are at increased risk of being hurt because of reduced reaction time resulting from the metal bats' increased power and attendant increased ball speed.

Many leagues are considering banning metal bats because of the safety issues, and secondarily because of performance issues.

The composite bat of the present invention addresses these issues and also provides a means for a player to progress from one playing level to the next level, where they will be required to use wood bats. It allows a player to use wood throughout an entire career, as the trend to use metal bats has produced an undesirable situation for players—when they get to the level where they are required to use wood, they are in essence unable to do so due to a lack of experience with it.

In addition to providing a bat that allows the use of wood throughout a career, the present invention provides for a longer lasting bat, as the composite bat of the present invention will not fray or peel as other compositions might.

When the composite bat of the present invention is used to strike a ball, the core members and outer members tend to act together to absorb the ball's impact by compressing and engaging with one another in an unexpected fashion for an even impact, no matter where the ball is impacted. This is true with even a glancing blow, and the result is a truer and more consistent strike and feel.

Additionally, the composite bat of the present invention conserves wood.

Only a small amount of the wood harvested for baseball bats is used. There is a need for a composite bat construction that makes a more efficient use of wood. The present invention allows pieces that would normally be scrapped to be usable.

Additionally in the case of a composite bat with a bamboo core, one is able to utilize wood that may otherwise be unable to be used in one piece, so instead of discarding that one is able to glue it into the bamboo core.

In the case of rubber wood, one is able to use a heavier wood core such as white oak, hickory or even of maple wood that would be too heavy to use for the entire bat can be used as the core member, with lighter wood used for the outer members.

Another way the present invention allows more use of wood is that any small portion of a piece of wood that has favorable grain, although not usable for an entire bat, can still be utilized for the outer members.

Moreover, with shell members one is able to utilize more wood because the grain does not have to be as strong to resist vibration.

Various attempts have been made to either provide composite baseball bats using wood or to provide composite baseball bats simulating wood more than conventional aluminum bats.

For example, U.S. Pat. No. 4,032,143 to Mueller et al. proposes an aluminum core surrounded by a form plastic body. Such a bat is said to be a lighter and less expensive bat suited for younger players (See, Column 1, lines 41-42).

U.S. Pat. No. 4,572,508 to Young proposes a baseball bat formed by a plurality of laminations held together by dovetail-shaped grooves and ridges. Layers of carbon fibers impregnated with a thermosetting resin are sandwiched between the wooden laminations to provide strength and shock absorbing characteristics.

U.S. Pat. No. 4,848,745 to Bohannon et al. proposes a cured foam core bat or bowling pin having circumferentially wound fibers sandwiched between two layers of fibers aligned with the longitudinal axis of the bat.

U.S. Pat. Nos. 5,114,144, 5,460,369 and 5,460,369 all to Baum disclose wood composite baseball bats having an aluminum core overwrapped with a composite reinforcing layer and covered with an outer layer of resin coated wood veneer. These bats are complex and expensive to manufacture, and uses an actual wood exterior to achieve the performance and appearance of a wood bat.

U.S. Pat. No. 5,301,940 to Seki et al. proposes a method of molding a baseball bat by winding reinforcing fibers around a core, placing this in a mold and injecting a resin which is a crosslinked polyaminoamide resin, a crosslinked epoxy modified polyamidoamide resin or a polyesteramide resin into the mold and curing the bat.

U.S. Pat. No. 5,395,108 to Sauders et al. proposes a synthetic wood composite bat comprising a shell of fiber reinforced resin material, a fiber tube inside the shell and a rigid cured polyurethane form filling the shell and penetrating the inner portion of the tube.

U.S. Pat. No. 5,409,214 to Cook proposes a baseball bat having a hollow metal handle portion and a solid wood barrel portion positioned in the handle portion.

U.S. Pat. No. 5,800,293 to MacKay, Jr. proposes a laminated wood bat constructed of a plurality of thin wood veneer bundled together throughout its facing surfaces.

None of these bats, however, sufficiently match the beneficial characteristics of existing wooden baseball bats or offer the other advantages of the present invention. Therefore, it can be appreciated that there is still a need for an improved composite baseball bat structure.

It is therefore an object of the invention to provide a composite baseball bat that substantially mimics the appearance, performance and sound of a conventional wood bat.

It is a further object of the present invention to make more efficient use of the wood available for baseball bats.

It is yet another object of the invention to provide a composite baseball bat that is more durable than an all-wood bat.

SUMMARY OF THE INVENTION

To this end, the present invention provides a composite baseball bat. The baseball bat generally has a symmetrical configuration in the form of a core portion surrounded by a plurality of outer portions.

DETAILED DESCRIPTION OF INVENTION

The present invention now will be described more fully hereinafter with reference to the accompanying drawings, in which some embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
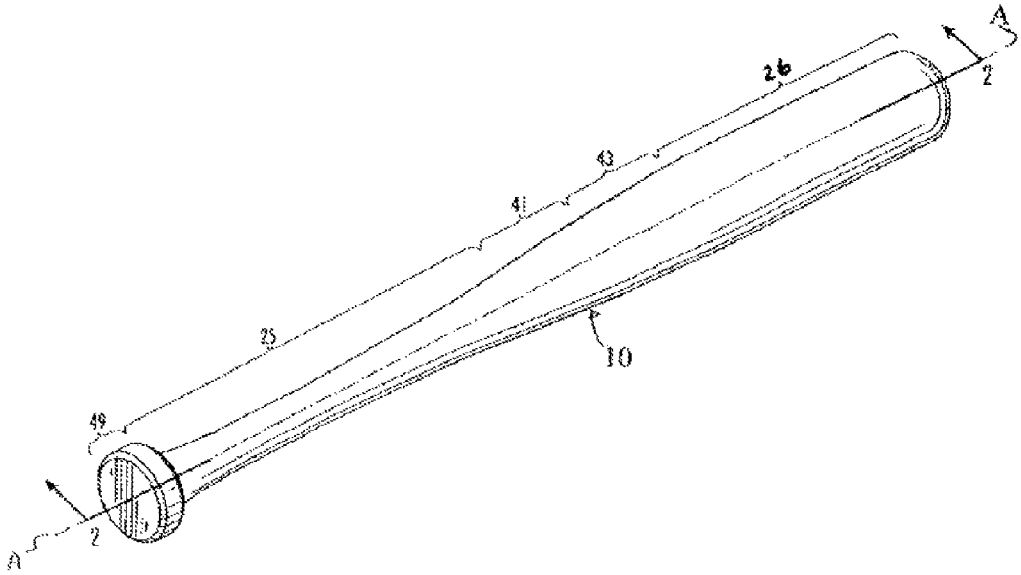
FIG. 1 is a perspective view of the an embodiments of the composite bat of the present invention.
Figure 2:
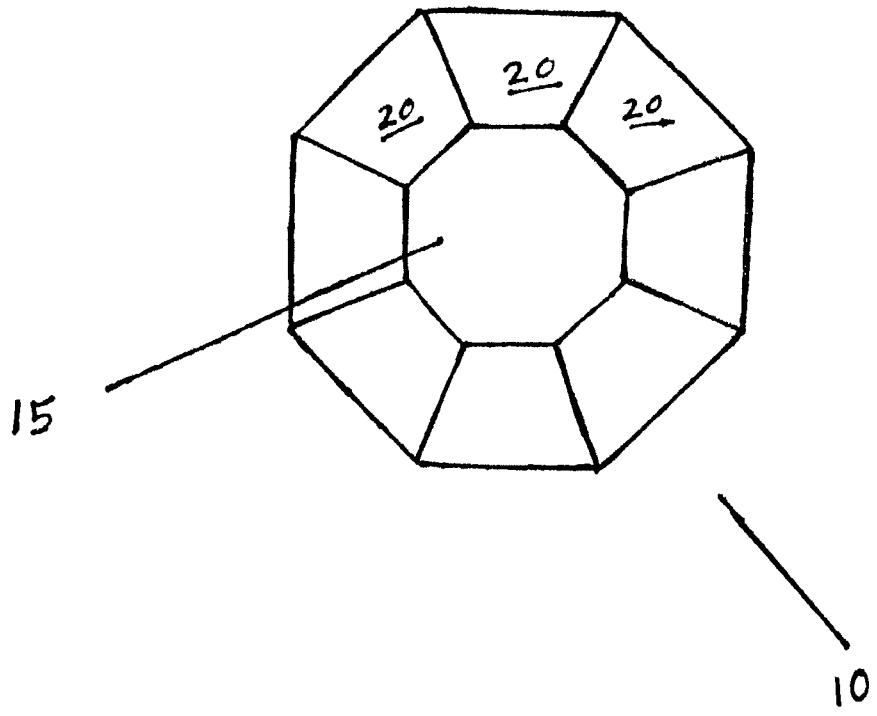
FIG. 2 is a cross-sectional view of an embodiment of the bat of the present invention taken along line 2-2 of FIG. 1, prior to final finishing.

Referring to FIGS. 1 and 2, bat 10 comprises a core portion 15 surrounded by outer portion 20. The bat has a barrel portion 26, a handle portion 25, a throat portion 41, a transition portion 43 between the barrel portion and the throat portion, and a knob portion 49. A longitudinal axis A extends through the core and its bat. It is understood that although a baseball bat has been described, the present invention is applicable to other bats and articles such as those used to play softball and cricket, for example, and to clubs such as billy clubs and any other suitable application.

Referring to FIG. 2, the bat 10 of the present invention can be seen in cross section. Core portion 15 is preferably made of a strong flexible wood such as ash, hickory, white oak, walnut, elm, or bamboo. In the embodiment shown, the core is octagonal but any suitable polygonal shape may be used—triangle, square, pentagon, hexagon, etc. In the embodiment shown the diameter of the core portion 15 is approximately 1⅜ inches and the bat billet length is 37 inches. In the embodiment shown, each side of the octagon is 9/16 inches in length.

Bat 10 further comprises a plurality of outer portions 20 surrounding the core. These are preferably made of a stiffer, harder wood, such as maple rubberwood or ash. In the case of an octagonal core, the outer portions are necessarily trapezoidal. The shapes of the shell portions obviously depend on the corresponding shape of the core.

The shell portions are attached to the core via any suitable method as is well known in the art, such as with polyurethane wood glue using a vacuum sealed process.

In the embodiment shown, the trapezoidal outer portions 20 are ¾ inches deep, with the short side measuring 9/16 inches and the long side measuring 1 3/16 inches. They are 37 inches long. These results in an angle of 22.5° at the base of each trapezoid. The angled sides of the trapezoids are 13/16 inches long.

The result of this assembly is a bat billet that is generally octagonal in shape that is 2⅞ inches in diameter and 37 inches long. The billet is then turned on a lath by known methods to provide a bat with a barrel that measures 2⅜-2⅝ inches in diameter as the barrel taper.

Figure 3:
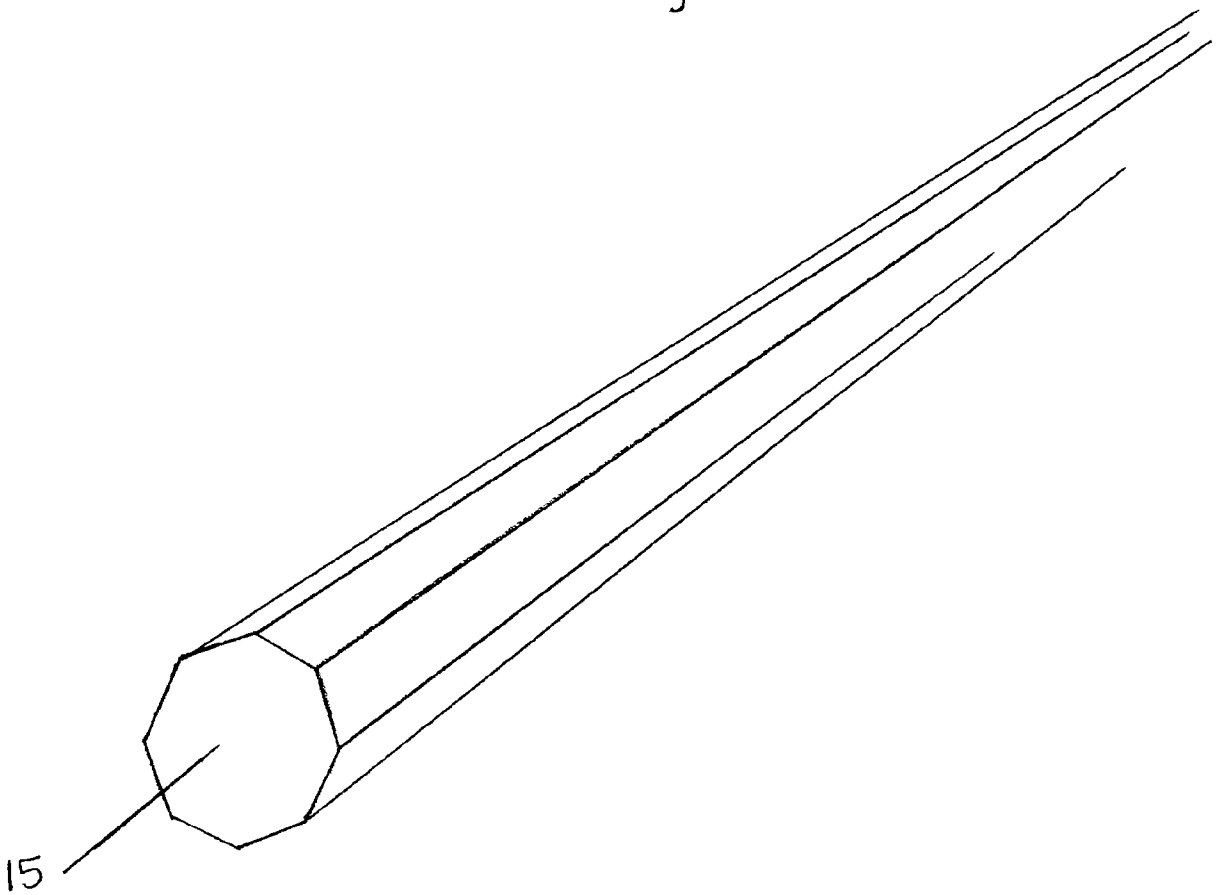
FIG. 3 is a perspective view of the core portion of the an embodiments of the composite bat of the present invention.
Figure 4:
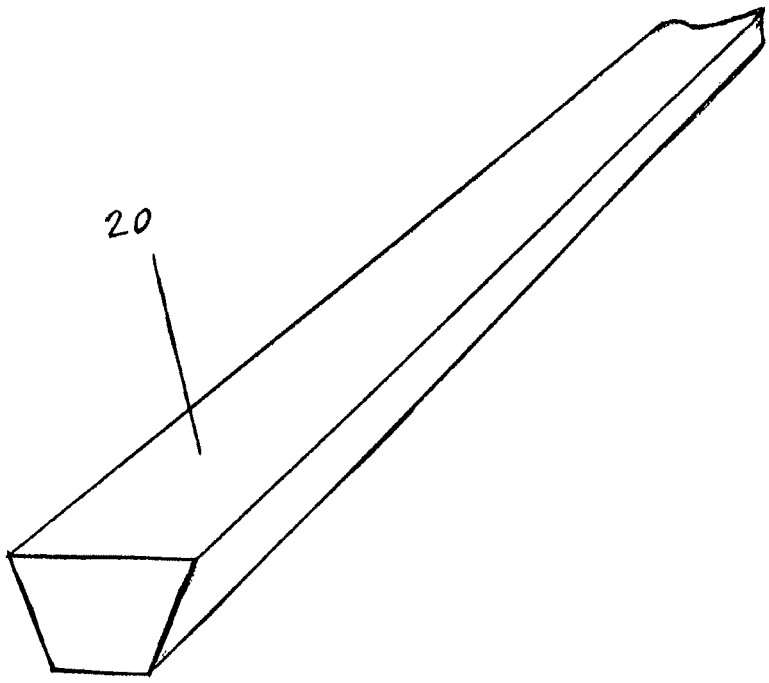
FIG. 4 is a perspective view of an outer portion of an embodiments of the composite bat of the present invention.

FIG. 3 shows the core member 15 in octagonal form. FIG. 4 shows a trapezoidal outer member.

Figure 5:
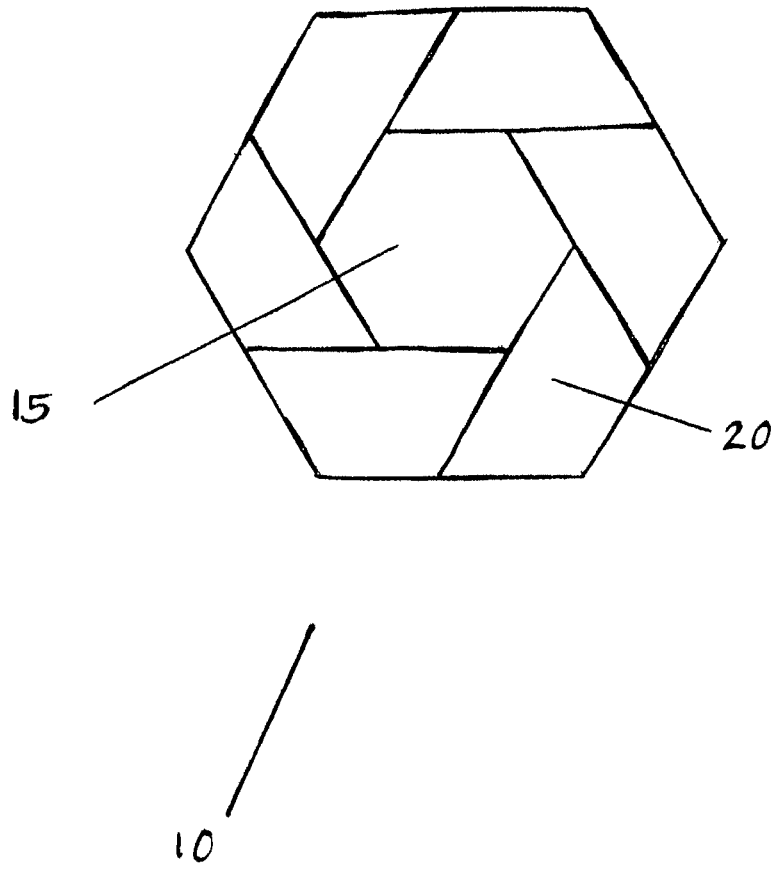
FIG. 5 is a cross-sectional view of another embodiment of the composite bat of the present invention.

FIG. 5 shows another embodiment of the composite bat of the present invention in which the core member 15 is hexagonal, resulting in trapezoidal outer member 20 of a modified size and shape. In this embodiment, the core is a hexagon and the outer members are interlocking trapezoids. It is readily apparent that any suitable polygon may be used for the core (triangle, square, etc.) with attendant leg members. The shapes used will depend on the preparation of the materials used and the materials that are available.

Figure 6:
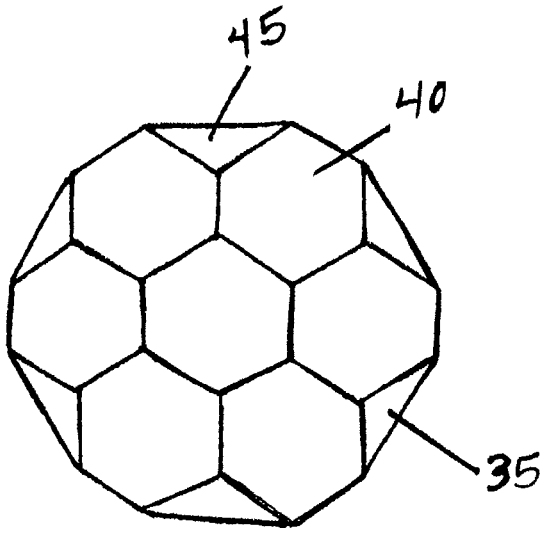
FIG. 6 is a cross-sectional view of another embodiment of the bat of the present invention composed of a plurality of members that are arranged in a "honeycomb" pattern.

FIG. 6 shows another embodiment 35 of the present invention that instead of using a core member and outer members uses a plurality of members that are glued together into a "honeycomb" shaped bundle prior to finishing. Members 40 are hexagons with a ⅞ inch side made of hickory, ash or oak. They are surrounded by oak triangular members 45.

Figure 7:
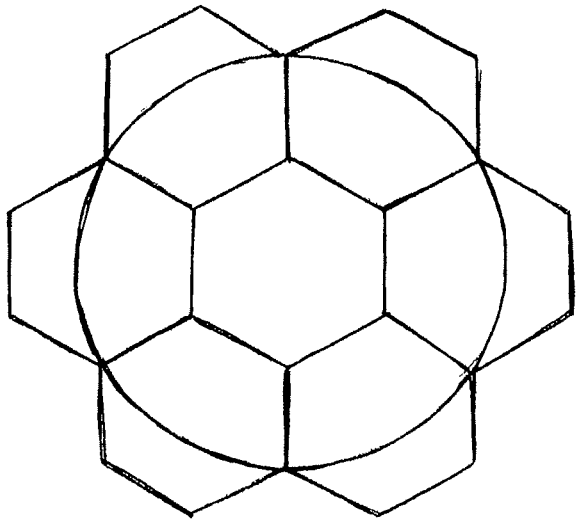
FIG. 7 is a cross-sectional view of the honeycomb embodiment prior to finishing.
Figure 8:
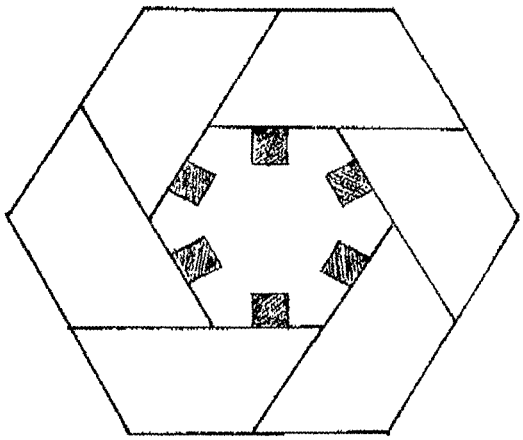
FIGS. 8-15 are cross sectional and perspective views of various embodiments of the bat of the present invention with compressed hardwood inserts placed in various locations, the inserts shown as shaded.
Figure 9:
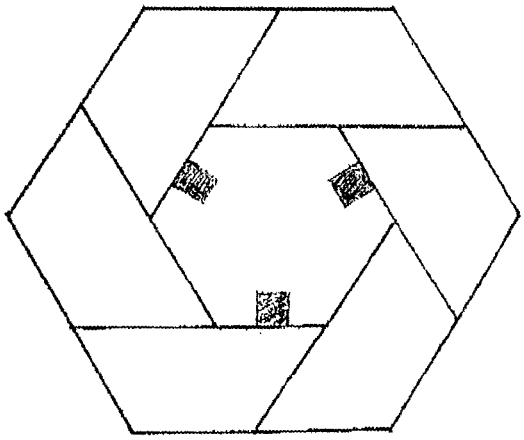
Figure 10:
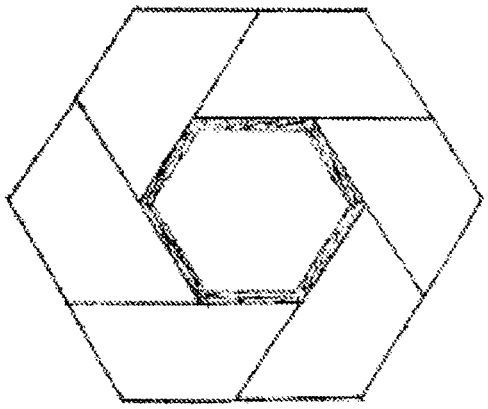
Figure 11:
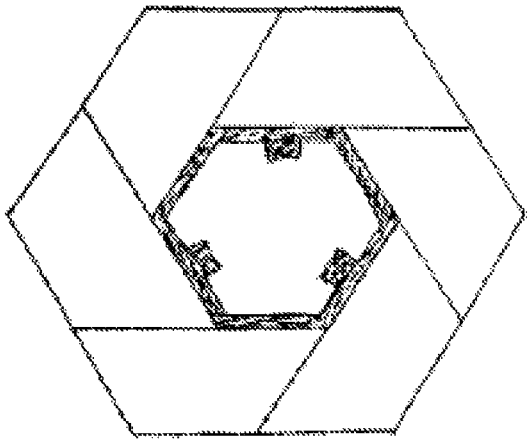
Figure 12:
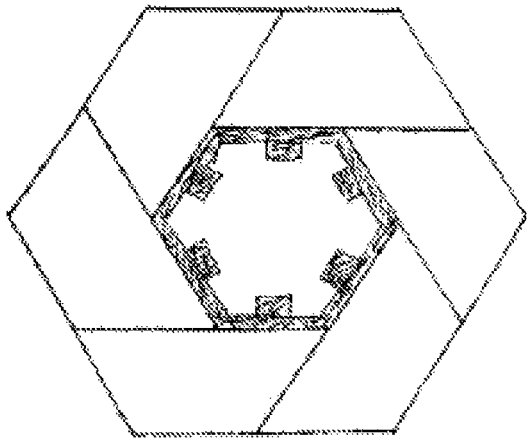
Figure 13:
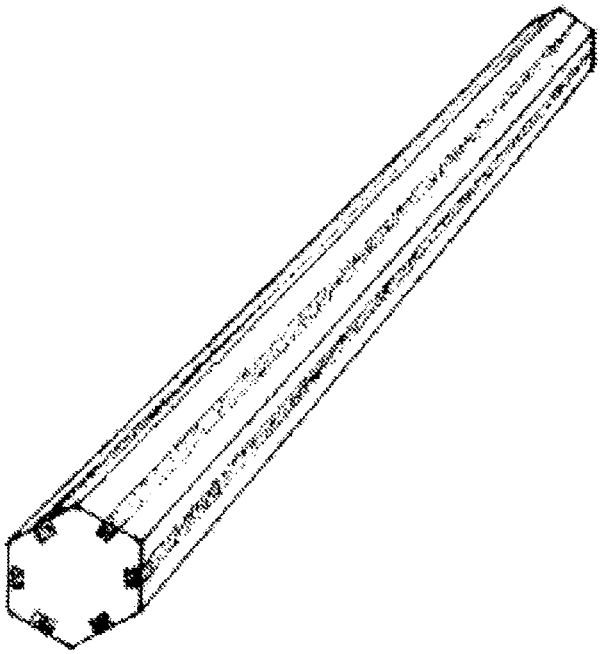
Figure 14:
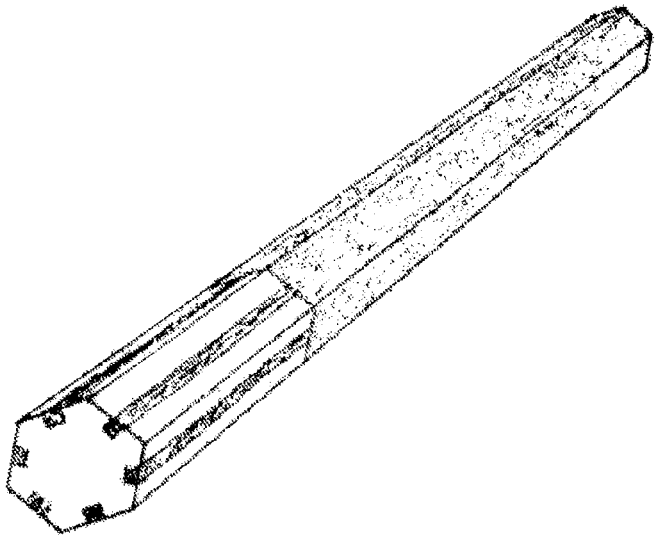
Figure 15:
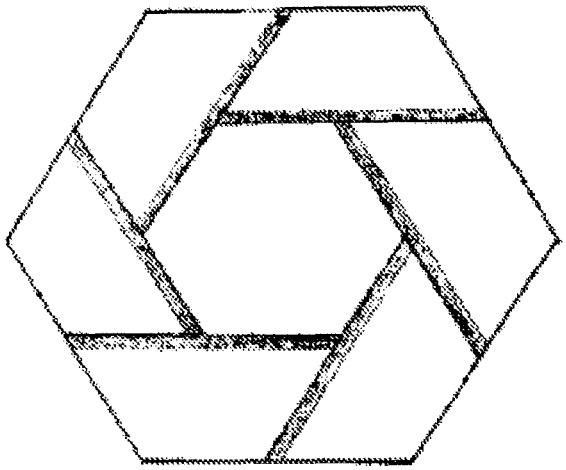

FIG. 7 shows yet another embodiment, prior to finishing, of just hexagons.

Figure 16:
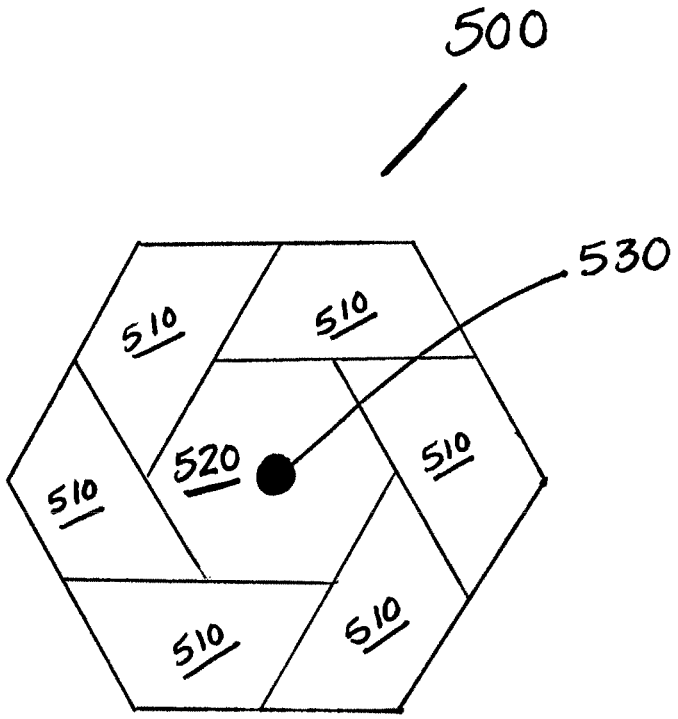
FIG. 16 is a cross-sectional view of a further embodiment of the present invention with a compressed hardwood core.

FIGS. 8-15 shows further embodiments of the present invention with compressed wood sections shown shaded, in various locations. In Compressed hardwood sections are included in the bat structure for improved durability and performance. In the configurations using compressed hardwood, the compressed hardwood is represented in the drawings by shaded areas. The use of a compressed hardwood maximizes flex, as well as utilizing the spring/give of the natural wood. It also dampens vibration for a more comfortable strike. This will in turn send the ball further than a one peace wooden bat and rival the metal and composites that are subject to BBCOR (Batted Ball Coefficient of Restitution) specifications. The sizing of the compressed hardwood can be adjusted as necessary and desired according to size and shape of bat and to meet BBCOR regulations FIG. 16 is a cross-sectional view of a further embodiment of the present invention with a compressed hardwood core. Bat 500 comprises six trapezoidal hardwood sections 510, preferably of rubber-wood or a similar lightweight wood. Core 520 is a hexagon preferably of hickory or white oak. In the center of core 520 is a compressed hardwood section 530 that is dovetailed into core 520, of any desired size. The embodiment shown has a round core, such as a dowel shape. This section provides improved performance.

The use of a heavier core of compressed wood provides a perfect balance of desired characteristics, such as a dowel shaped member. The more weight that is toward the batter's hands, the lighter the bat "feels." This embodiment affords a heavier bat without the top heavy feel. Bat weight combined with bat speed is what will ultimately send the ball the farthest. Again, the compressed hardwood will have a vibration dampening effect which will make for a more comfortable swing.

Figure 17:
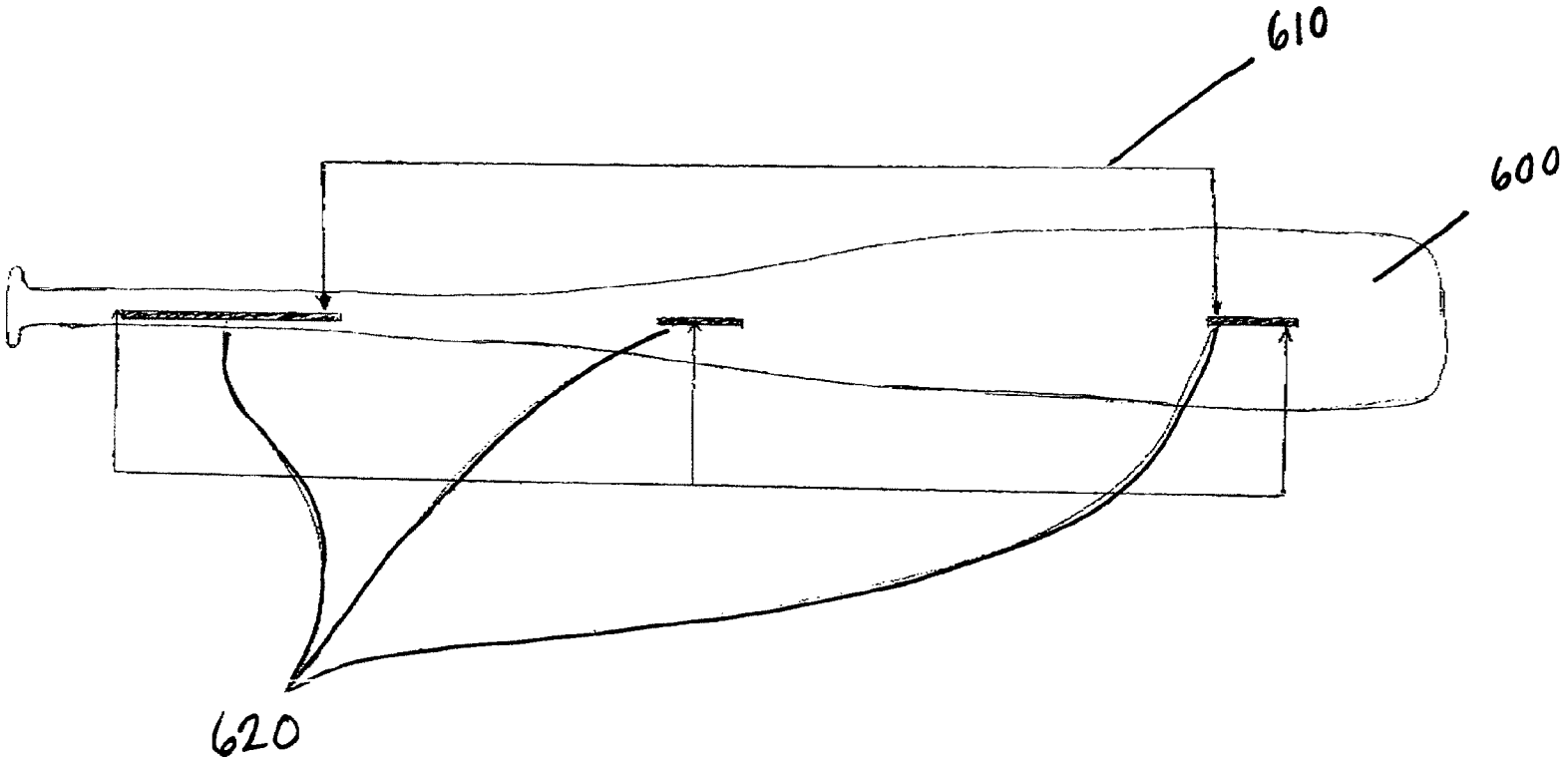
FIG. 17 is a schematic view of a bat showing the typical vibration points.

FIG. 17 is a perspective view of a bat showing vibration points. Bat 600 has initial vibrations points 610 and secondary vibration points 620. Compressed hardwood implants dampen vibration and maximize flex, which lengthens bat life. Vibration and lack of flexibility are two key factors in bat breakage. FIG. 17 shows the vibration points that compressed hardwood inserts help resolve and minimize.

In yet another embodiment of the present invention, a Kevlar strand splinter inhibitor is used. The glue joints in wood laminated baseball bats are stronger and less likely to fail then the wood itself. To solve that problem, the present invention may include micro grooves filled with a Kevlar. This inhibits splintering, which can become airborne. The groove and strand would match in size so that when a finish is applied to the bat, it is virtually undetectable.

Figure 18:
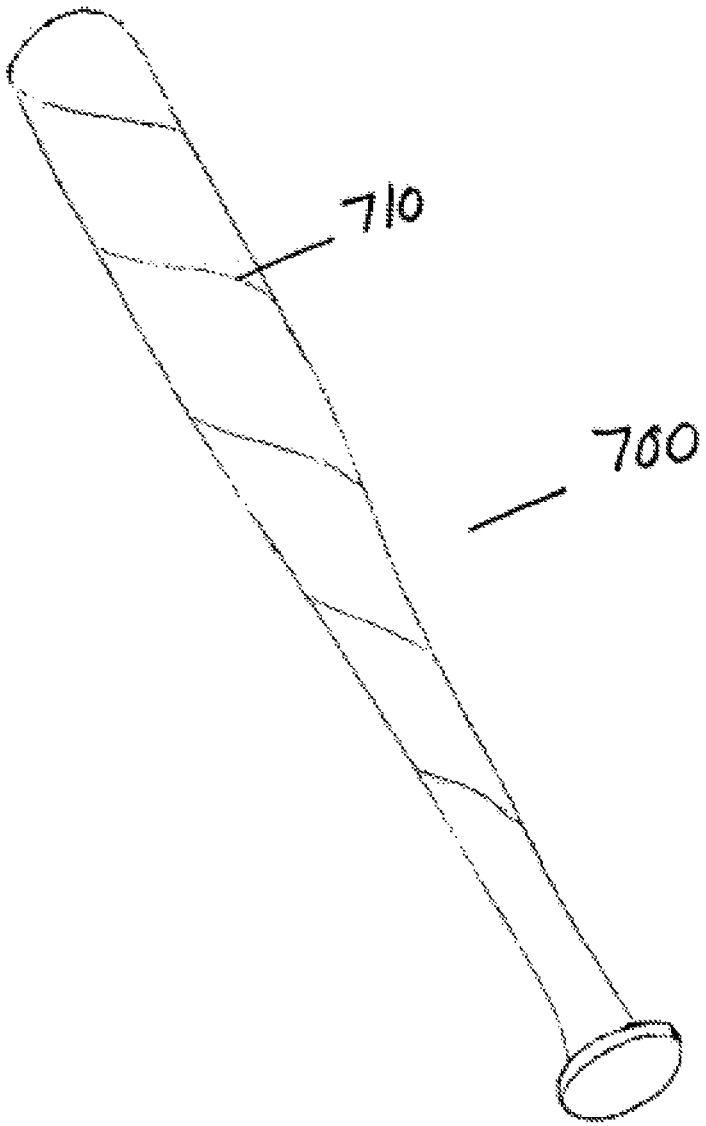
FIG. 18 is a perspective view of an embodiment of the bat of the present invention with Kevlar strand inhibitors.

In FIG. 18, Bat 600 contains Kevlar strands, which are retained in grooves (not shown) and which blend in with the finished bat. Kevlar or any other suitable material may be used for the purpose of reducing splinters.

Figure 19:
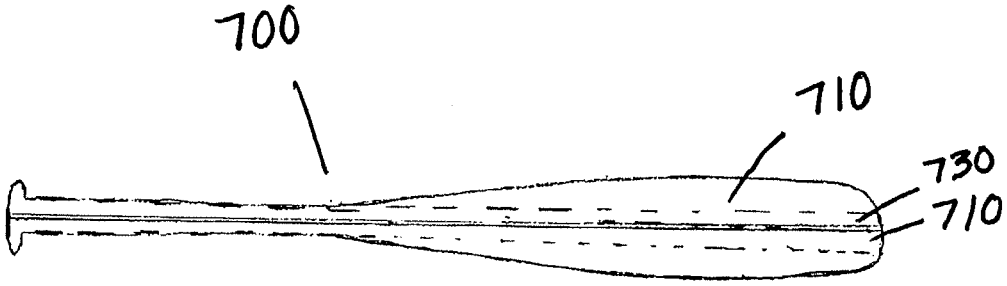
FIG. 19 is a perspective view of yet another embodiment of the bat of the present invention.

FIG. 19 shows a further embodiment of the present invention. Bat 700 comprises a core 710 of compressed hardwood, which runs the entire length of the bat. Core 730 is preferably made of a strong hardwood such as hickory or white oak. Shell 740 preferably comprises a light weight hardwood.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

I claim:

1. A composite bat comprising:

an inner core member comprising a first section and a second section, wherein the first section comprises a compressed wood portion, and the second section comprises uncompressed wood; and a plurality of outer shell members, wherein each one of said plurality of outer shell members comprises uncompressed wood;

said plurality of outer shell members surrounding said inner core member and fixed to said inner core member to form a composite structure, and said compressed wood portion consisting of a singular piece.

2. The composite bat of claim 1, wherein the first section of the inner core member comprises a substantially cylindrical shape and extends along a longitudinal axis of the bat.

3. The composite bat of claim 1, wherein the inner core member comprises a polygonal shape and extends along a longitudinal axis of the bat.

4. The composite bat of claim 3, wherein the inner core member comprises a hexagonal shape.

5. The composite bat of claim 1, wherein the compressed wood portion occupies a center portion of the inner core member, the center portion extending along the longitudinal axis of the bat.

6. The composite bat of claim 3, wherein the compressed wood portion occupies a center portion of the inner core member, the center portion extending along the longitudinal axis of the bat.

7. The composite bat of claim 6, wherein the compressed wood portion comprises a substantially round shape.

8. The composite bat of claim 6, wherein the inner core member comprises hardwood.

9. The composite bat of claim 6, wherein the compressed wood portion comprises hardwood.

10. The composite bat of claim 3, wherein the compressed wood portion occupies a peripheral portion of the inner core member, the peripheral portion extending parallel to the longitudinal axis of the bat.

11. The composite bat of claim 1, wherein the inner core member further comprises a third section comprising compressed wood.

12. The composite bat of claim 1, wherein the inner core member further comprises a plurality of compressed wood sections.

13. The composite bat of claim 12, wherein each one of the plurality of compressed wood sections comprises a singular piece.

14. The composite bat of claim 4, wherein the compressed wood portion occupies a center portion of the inner core member, the center portion extending along the longitudinal axis of the bat.

* * * * *